US008336123B2

(12) United States Patent
Gleason et al.

(10) Patent No.: US 8,336,123 B2
(45) Date of Patent: Dec. 25, 2012

(54) LATCHING MECHANISM FOR RETENTION OF FACE SHIELD LENS

(75) Inventors: Wayne Gleason, West Greenwich, RI (US); Raymond Curci, Smithfield, RI (US); Brett Pulito, Blackstone, MA (US)

(73) Assignee: Honeywell International, Inc., Morristown, NJ (US)

( * ) Notice: Subject to any disclaimer, the term of this patent is extended or adjusted under 35 U.S.C. 154(b) by 26 days.

(21) Appl. No.: 13/113,019

(22) Filed: May 20, 2011

(65) Prior Publication Data

US 2012/0291173 A1 Nov. 22, 2012

(51) Int. Cl.

| | |
|---|---|
| ***A42B 1/08*** | (2006.01) |
| ***A42B 1/24*** | (2006.01) |
| ***A42B 1/00*** | (2006.01) |
| ***A61F 9/00*** | (2006.01) |

(52) U.S. Cl. ..... 2/424; 2/422; 2/9; 2/10

(58) Field of Classification Search ..... 2/410, 6.1, 2/6.2, 6.3, 6.5, 6.6, 6.7, 7, 8.1, 8.2, 421, 422, 2/424, 425, 9, 209.13, 206; D29/104, 105, D29/106, 107, 108, 109, 110

See application file for complete search history.

(56) References Cited

U.S. PATENT DOCUMENTS

| | | | | |
|---|---|---|---|---|
| 2,360,482 | A | 7/1943 | Evans | |
| 2,397,722 | A * | 4/1946 | Bowers | 2/8.1 |
| 2,729,820 | A | 1/1953 | Anderson | |
| 2,829,374 | A | 4/1958 | Malcom, Jr. | |
| 3,214,767 | A | 12/1962 | Weber | |
| 3,380,073 | A * | 4/1968 | McLaughlin | 2/8.1 |
| 3,594,816 | A * | 7/1971 | Webb et al. | 2/10 |
| 3,686,690 | A * | 8/1972 | Webb | 2/9 |
| 4,475,254 | A * | 10/1984 | Bay | 2/424 |
| 4,625,341 | A | 12/1986 | Broersma | |
| 4,856,109 | A * | 8/1989 | Desy et al. | 2/9 |
| 4,884,302 | A * | 12/1989 | Foehl | 2/424 |
| 5,673,431 | A | 10/1997 | Batty | |
| 2007/0220649 | A1 * | 9/2007 | Huh | 2/9 |
| 2008/0276355 | A1 * | 11/2008 | Lawrence | 2/424 |
| 2011/0113519 | A1 * | 5/2011 | Gendron et al. | 2/2.5 |
| 2011/0154551 | A1 * | 6/2011 | Spink | 2/10 |
| 2012/0031413 | A1 * | 2/2012 | Shi et al. | 128/858 |

* cited by examiner

*Primary Examiner* — Shelley Self
*Assistant Examiner* — Jane Yoon
(74) *Attorney, Agent, or Firm* — Barlow, Josephs & Holmes, Ltd.

(57) ABSTRACT

A face shield includes a crown, a head gear, and a lens removably secured to the crown with a latch lever having a wide paddle-shaped actuator that is easily manipulated from the rearward edge of the crown. The crown has an opposing pair of studs extending inwardly from the lower edge. The upper edge of the lens includes an opposing pair of keyhole-shaped slots adjacent its opposing side edges which receive and rotatably engage the studs. The engagement end of the latch includes a spaced pair of detents. The fulcrum is secured to an inner surface of the crown so that the engagement end of the latch extends toward the front edge of the crown and the upper actuator end extends toward the rearward edge of the crown. The upper edge of the lens includes a pair of spaced openings that releasably engage the detents on the latch lever.

19 Claims, 11 Drawing Sheets

LATCHING MECHANISM FOR RETENTION OF FACE SHIELD LENS

BACKGROUND

The present specification relates to a protective face shield of the type having a crown and an arcuate transparent lens removably secured to the crown. More particularly, the specification relates to an improved latching mechanism for releasably securing the lens to the crown in order to facilitate the exchange of replacement lenses.

Generally speaking, the product offerings currently sold in the marketplace, while providing a secure means of attachment for a replacement lens, are predominantly complex in design, as well as method of use. They often require multiple steps that are difficult, and require considerable dexterity and time. Typically, multiple attachment points need to be disengaged in order to release the lens. This can be problematic to the end user, even if they understand how the attachment system works and even more problematic if they do not. Furthermore, the end user of such a face shield often wears gloves along with the face shield. Gloves significantly reduce the dexterity of the user in performing detailed manipulations of small parts. Accordingly, replacement of a lens while wearing gloves is almost impossible with the current products.

The effects of these complexities is that the end user may not replace a worn or compromised lens as frequently as needed, resulting in poor visibility, reduced productivity, and more importantly, potentially resulting in injury.

SUMMARY

An improved protective face shield comprises a crown, a head gear pivotably attached to the crown, and an arcuate transparent lens removably secured to the crown with a latching mechanism having a wide paddle-shaped actuator that is easily accessible from the rearward edge of the crown.

The crown has a shape contoured to conform to the shape of the forehead, a forward edge, a rearward edge and an opposing pair of rotational studs extending inwardly from an inner surface of the forward edge at opposing sides thereof.

The upper peripheral edge of the lens includes an opposing pair of keyhole-shaped slots adjacent its opposing side edges. The keyhole-shaped slots are configured and arranged to receive and rotatably engage the rotational studs whereby the lens is received on the studs and rotatable upwardly about the studs into a groove in the forward edge of the crown.

The latching mechanism is a latch lever having an upper actuator end, a lower engagement end and a fulcrum located therebetween. The lower engagement end of the latch includes a spaced pair of forwardly extending detents and the upper end is formed in the shape of a wide paddle to facilitate movement. The fulcrum is secured to an inner surface of the crown above the front edge so that the lower engagement end of the latch extends toward the front edge of the crown and the upper actuator end extends toward the rearward edge of the crown.

The upper peripheral edge of the lens includes a pair of spaced openings configured and arranged to receive and releasably engage the forwardly extending detents on the engagement end of the latch lever.

In operation, the latch lever is pivotably movable about the fulcrum between an engaged position wherein the detents on the lower engagement end project forwardly into engagement with the openings in the upper peripheral edge of the lens and a released position wherein the detents are disengaged from the opening.

To retain the latch lever in engagement with the lens, a spring is captured between the actuator end of the latch lever and the inner surface of the crown where the spring normally biases the latch lever into engagement with the lens.

Accordingly, an objective is to provide an improved latching mechanism for the lens that will reduce the time, effort and complexity involved in the replacement of a damaged or compromised lens in a protective face shield.

Another objective is to provide an improved latching mechanism that can be easily manipulated while wearing gloves.

Still another objective is to provide a latching mechanism which is natural to use, easy to locate, and easily accessible.

Yet another objective is to provide a latching mechanism which is accessible from the open rearward edge of the crown.

Other objects, features and advantages shall become apparent as the description thereof proceeds when considered in connection with the accompanying illustrative drawings.

BRIEF DESCRIPTION OF THE DRAWING FIGURES

The preferred embodiment will now be described further by way of example with reference to the following examples and figures, which are intended to be illustrative only and in no way limiting upon the scope of the disclosure.

DETAILED DESCRIPTION OF THE PREFERRED EMBODIMENT

Figure 1:
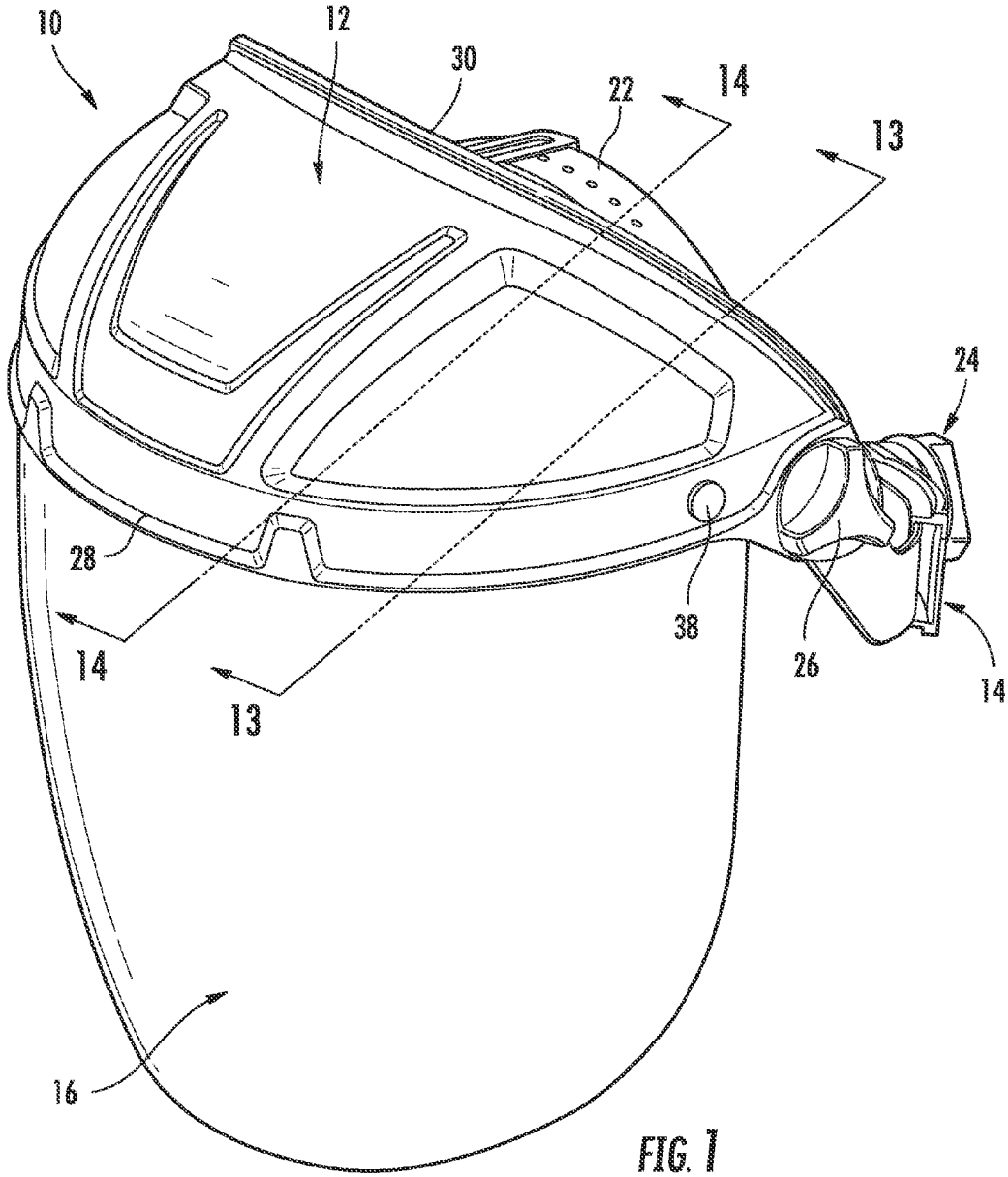
FIG. 1 is a perspective view of a face shield including the present latching mechanism.
Figure 2:
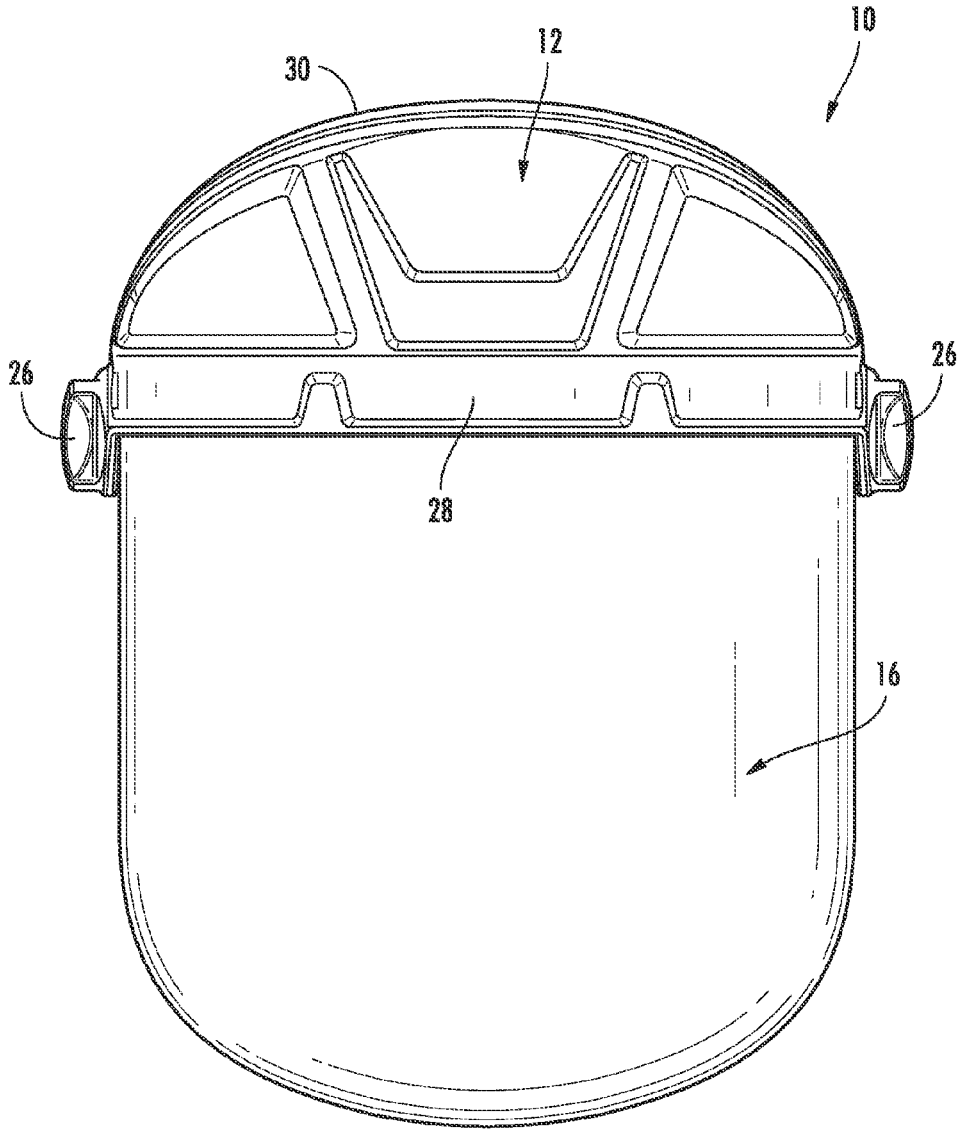
FIG. 2 is a front view thereof.
Figure 3:
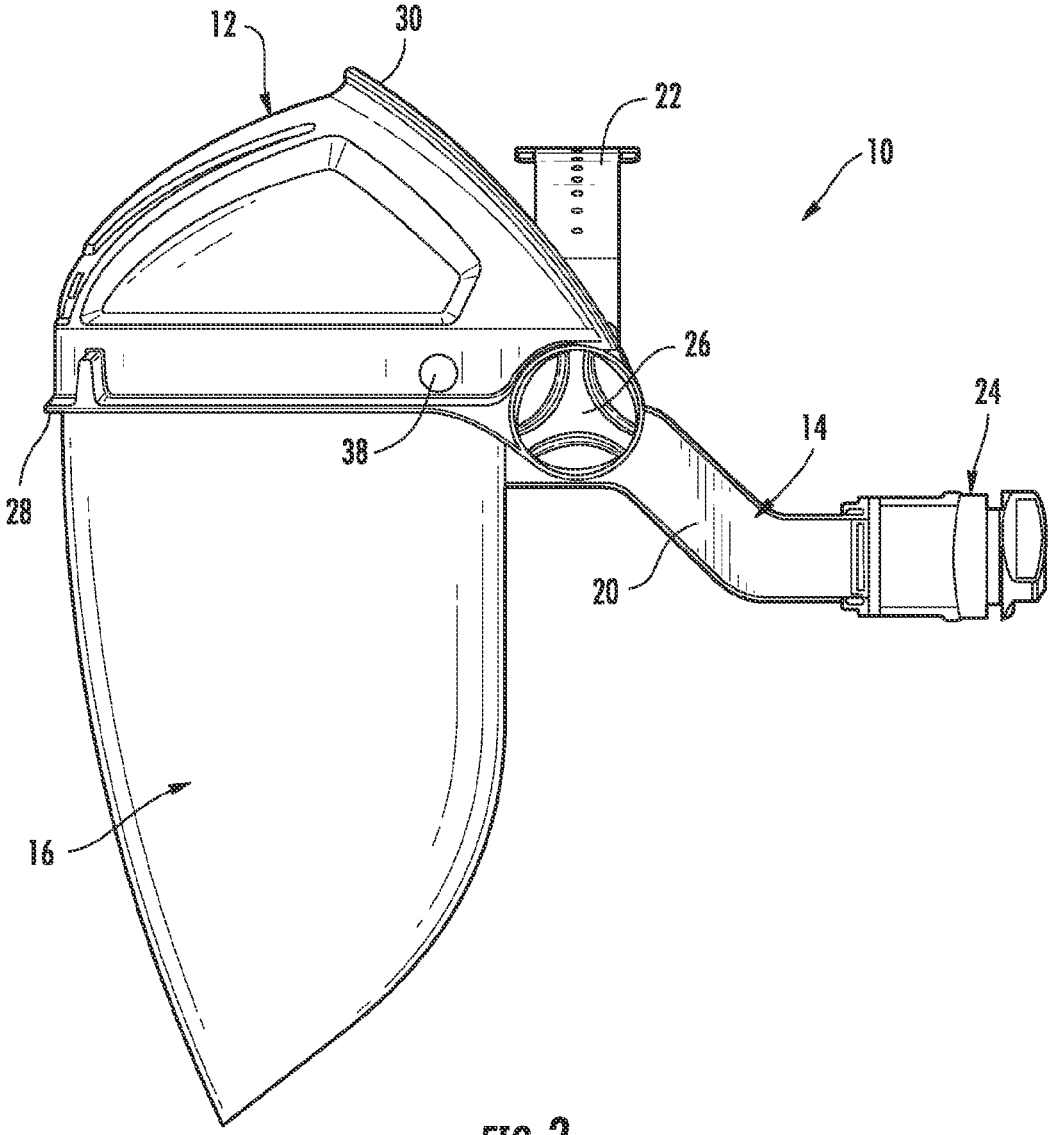
FIG. 3 is a side view thereof.
Figure 4:
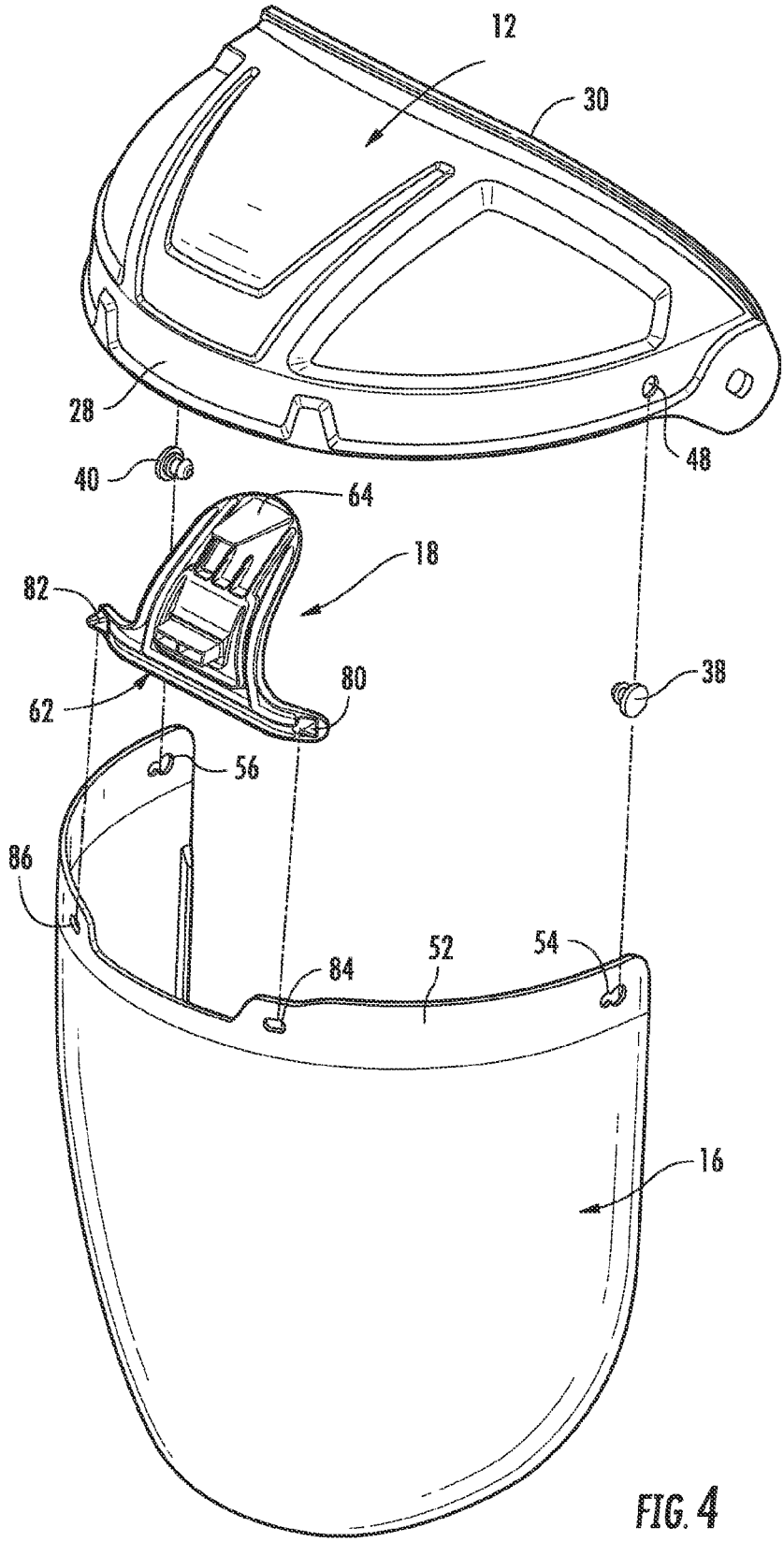
FIG. 4 is an exploded view thereof with the head gear removed.
Figure 4A:
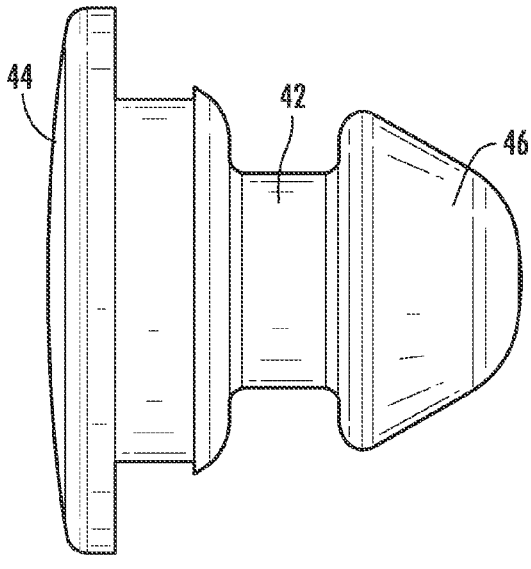
FIG. 4A is an enlarged view of one of the rotational studs.

A protective face shield generally indicated at 10 comprises a crown generally indicated at 12, a head gear generally indicated at 14 pivotably attached to the crown 12, and an arcuate transparent lens generally indicated at 16 removably secured to the crown 12 with a latching mechanism generally indicated at 18 having a wide paddle-shaped actuator that is easily accessible from the rearward edge of the crown 12.

The head gear 14 has a well-known construction and is preferably molded from a resilient plastic material. The head gear 14 comprises a circular band 20 that encircles the head, a cross-band 22 extending over the top of the head, and a rack and pinion adjustment adjusting mechanism 24 for sizing the circular band 20 to a desired circumference and depth to achieve a comfortable fit on the user's head. The head gear 14 is pivotably mounted to the crown 12 by pivots 26 at opposing sides.

Figure 13:
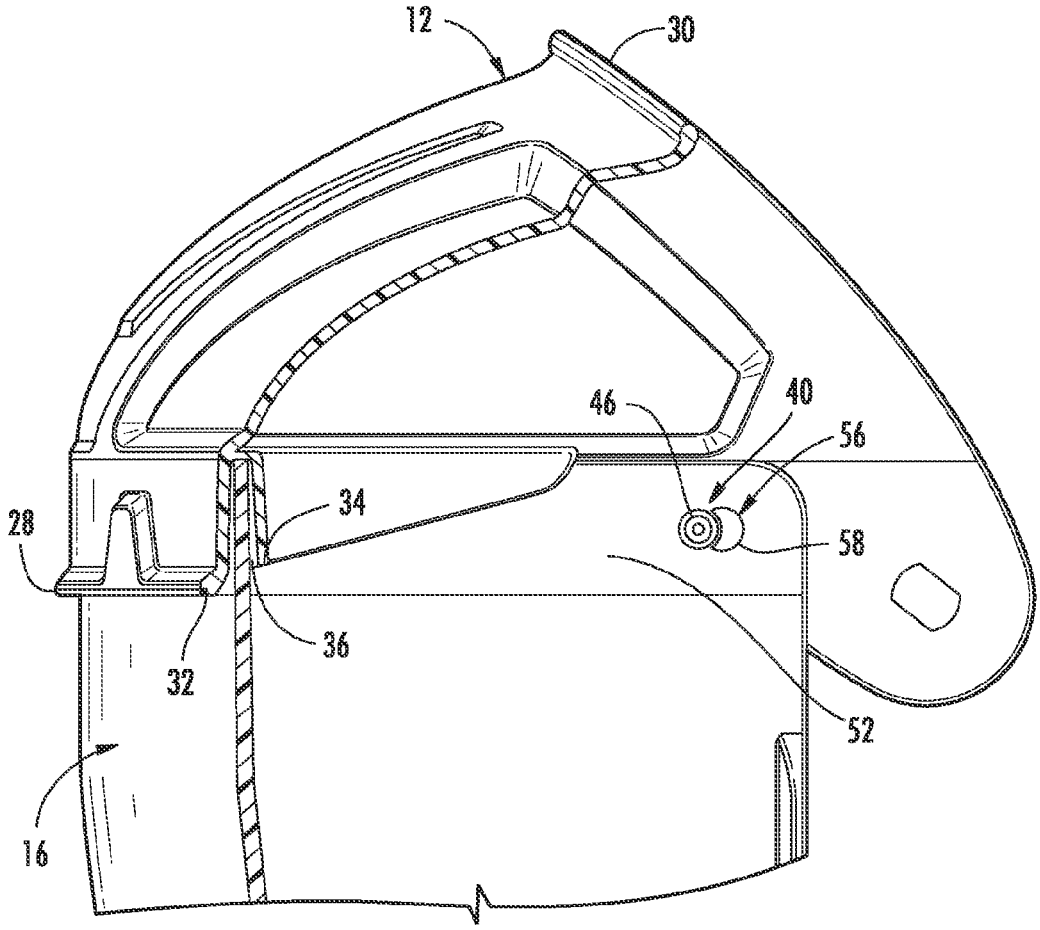
FIG. 13 is a cross-sectional view of the crown and lens taken along line 13-13 of FIG. 1.
Figure 14:
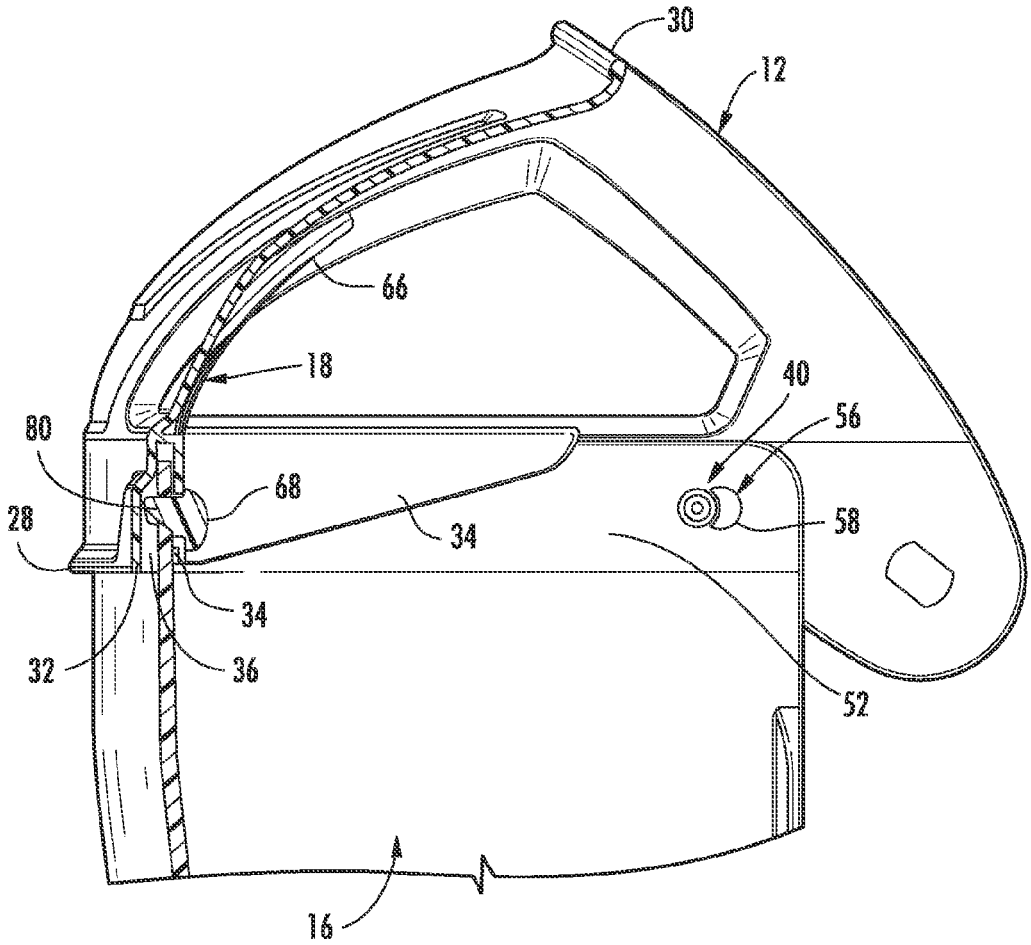
FIG. 14 is a cross-sectional view of the crown and lens taken along line 14-14 of FIG. 1.

The crown 12 is preferably a molded plastic component and has an arcuate shape contoured to conform to the shape of the forehead. The crown 12 includes a forward edge 28 adjacent the lower forehead area, and a rearward edge 30 adjacent to the top of the head. At the forward edge 28, the crown 12 includes an outer depending wall 32 and an inner depending 34 wall spaced radially inwardly from the outer wall to define a channel 36 therebetween. As can be seen in FIGS. 13 and 14, the lens 16 is seated within the channel 36 when assembled with the crown 12.

To secure the lens 16 to the crown 12 at the opposing sides, the crown 12 includes an opposing pair of rotational studs 38, 40 (See FIGS. 4, 4*a*, 6, 7, 13, 14). The studs 38, 40 each have a cylindrical shaft 42, an outer head 44 and an inner cap 46. The studs 38, 40 extend through opposed openings 48, 50 (FIG. 8) in the forward edge 28 of the crown 12 so that the shaft 42 and inner cap 46 extend inwardly toward the interior of the crown 12.

Figure 5:
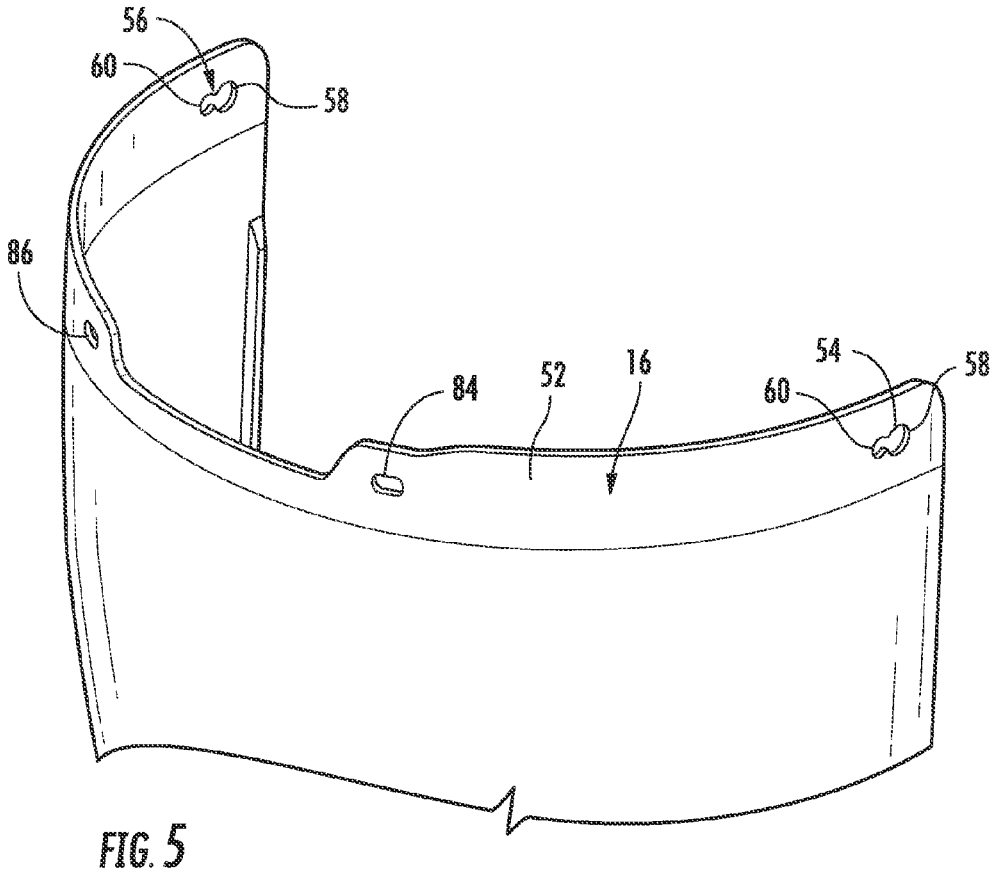
FIG. 5 is a cutaway perspective view of the upper peripheral edge of the lens.

The lens 16 is preferably molded from a transparent or translucent polycarbonate material. Other plastic materials and manufacturing methods for the lens are also contemplated within the scope of the disclosure. Referring to FIG. 5, the upper peripheral edge 52 of the lens 16 includes an opposing pair of keyhole-shaped slots 54, 56 adjacent its opposing side edges. The keyhole-shaped slots 54, 56 each have a larger circular opening 58 at the rear and a narrower slot 60 extending forwardly from the circular opening 58. The circular openings 58 are configured and arranged to receive the caps 46 of the rotational studs 38, 40 on the crown 12, and then as the lens 16 is shifted rearwardly, the smaller diameter cylindrical shafts 42 slide into the narrower slots 60. Once engaged, the front portion of the lens 16 is rotatable upwardly about the studs 38, 40 where the upper peripheral edge 52 is received into the channel 36 in the forward edge 28 of the crown 12.

While the illustrated embodiment includes interfitting studs and key-hole slots to provide a simplified installation of the lens, it should be understood that other configurations of interfitting mating formations are also possible so long as the formations on the lens permit the lens to be easily interfit with the opposing formation on the crown, and rotated into position.

The latching mechanism 18 comprises a latch lever 62 and a spring 64 for biasing the latch lever 62 to an engaged position. Preferably, the latch lever 62 and spring 64 are integrally molded as a single unit from a resilient plastic material.

Referring to FIGS. 8-11, the latch lever 62 includes an upper actuator end 66, a lower engagement end 68 and a fulcrum 70 located therebetween.

The upper actuator end 66 of the latch lever 62 preferably has the shape of an enlarged paddle or pad so that it is easily engaged by a gloved hand of a user. Preferably, the actuator end 66 is at least 1 inch wide, and more preferably is about 2 inches wide. The particular shape of the actuator end 66 is not particularly critical other than that it should have a width and depth that can be easily engaged by a gloved hand.

Figure 10:
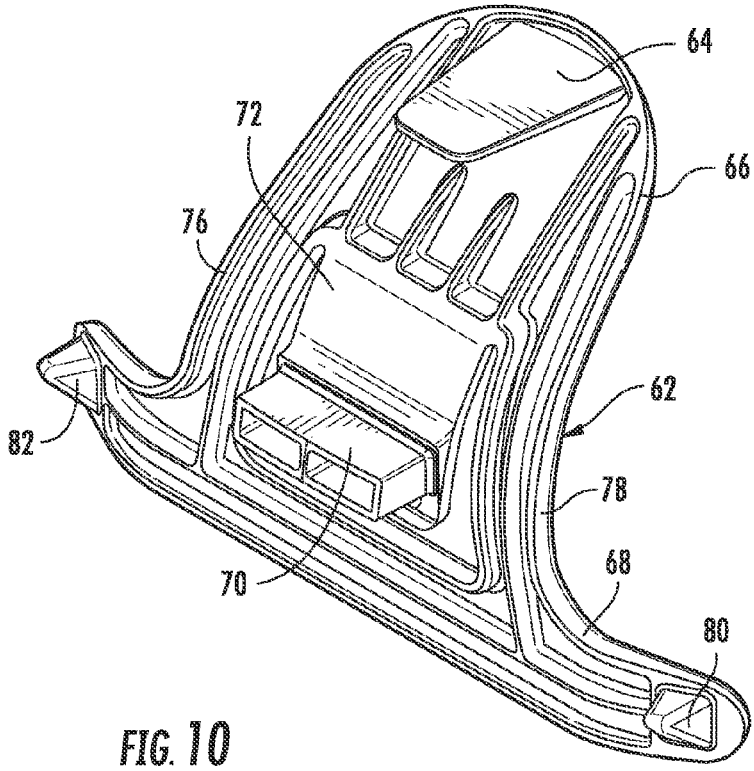
FIG. 10 is a front perspective view thereof.
Figure 11:
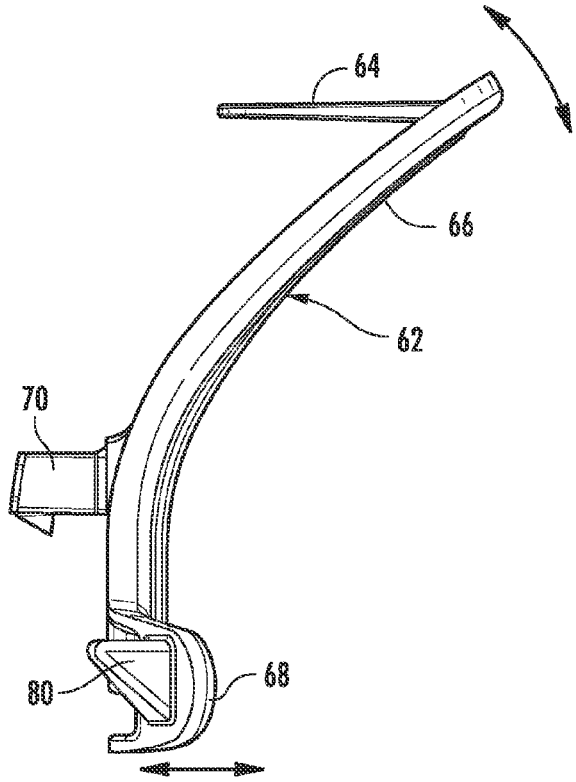
FIG. 11 is a side view thereof.

The fulcrum 70 of the latch lever 62 is formed as a flexible tab 72 depending downwardly from a central portion of the lower portion of the upper actuator end 66. Referring to FIG. 10, the fulcrum 70 is formed as a forwardly projecting post which is snap received into a mating slot 74 formed on the inner surface of the crown 12 (See FIG. 8). The lower engagement end 68 of the latch lever 62 is formed as a horizontally extending body supported by spaced arms 76, 78 which depend downwardly from outer portions of the lower edge of the upper actuator end 66. The lower engagement end 68 includes a spaced pair of forwardly extending detents 80, 82 which are configured and arranged to be received into corresponding openings 84, 86 in the upper peripheral edge 52 of the lens 16 (see FIGS. 12 and 14).

Figure 6:
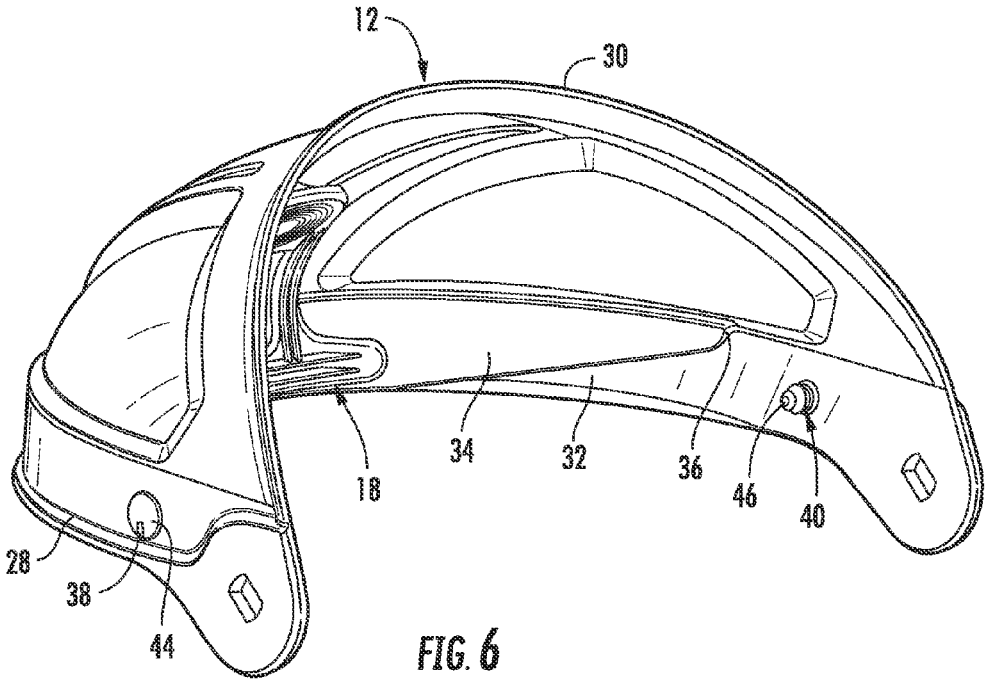
FIG. 6 is a rear perspective view of the crown including the rotational studs and the latch lever.
Figure 7:
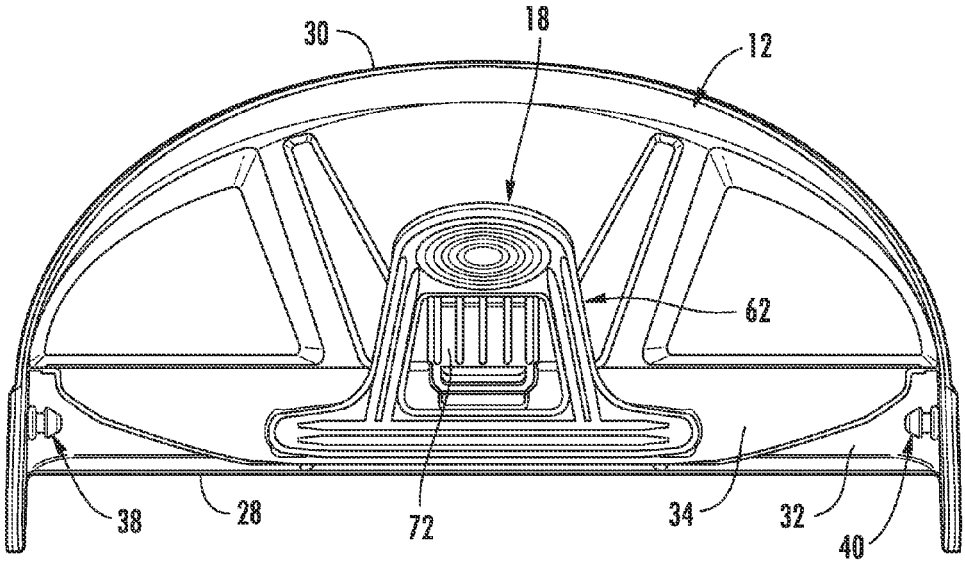
FIG. 7 is a rear view of the crown including the latch lever and rotational studs.
Figure 8:
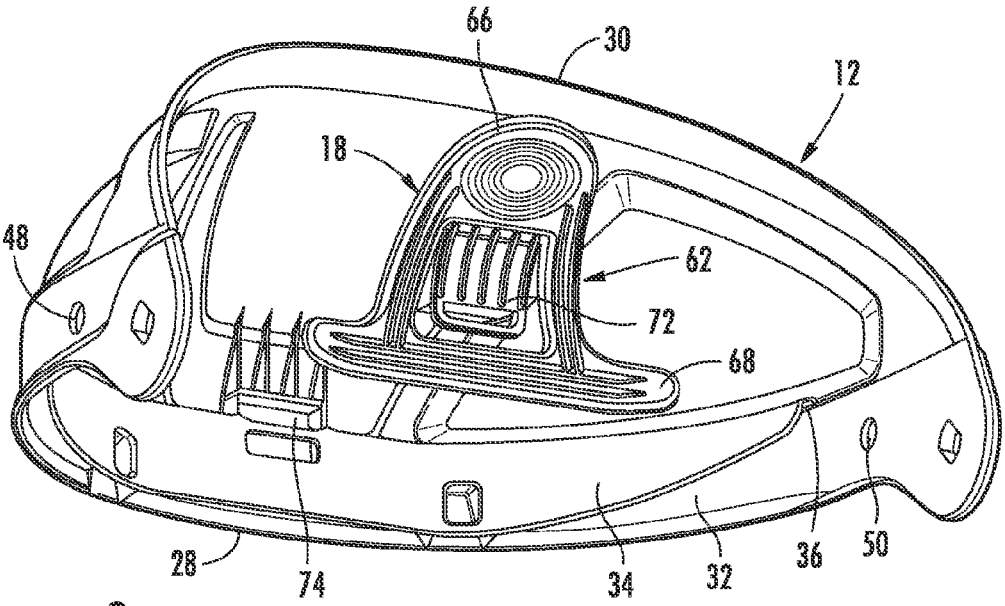
FIG. 8 is an exploded perspective view from the rear of the crown and latch lever.
Figure 9:
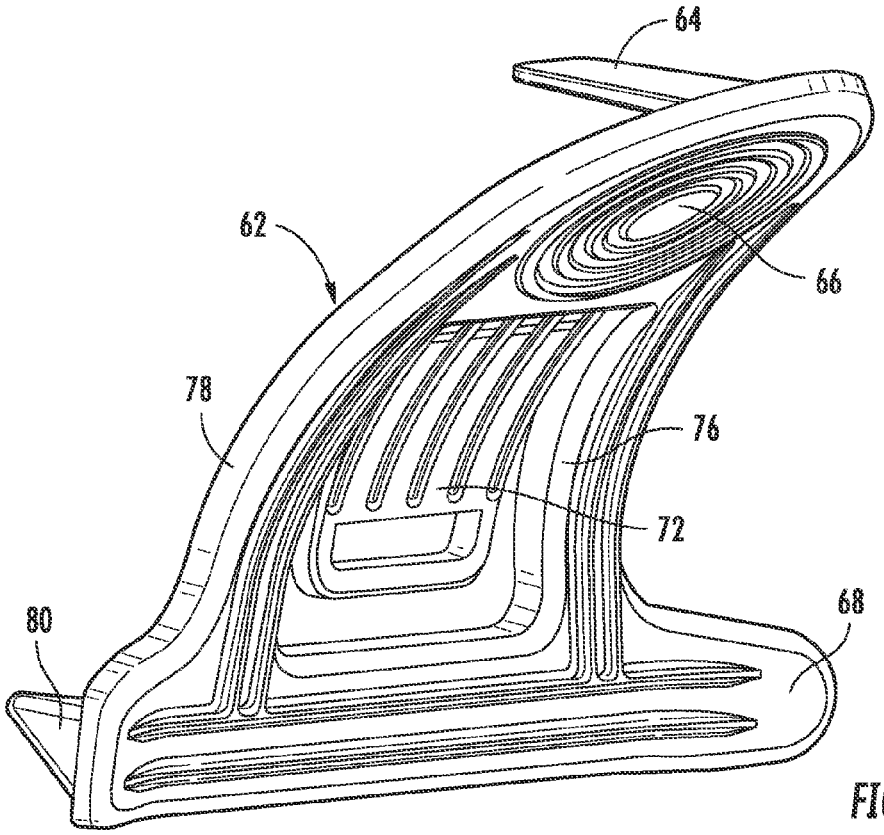
FIG. 9 is a rear perspective view of the latch lever.

Referring to FIGS. 6-8, the fulcrum 70 is secured to the inner surface of the crown 12 above the front edge 28 so that the lower engagement end 68 of the latch lever 62 extends toward the front edge 28 of the crown 12 and the upper actuator end 66 extends toward the rearward edge 30 of the crown. In this regard, the upper actuator end 66 is readily accessible from the rearward edge 30 of the crown 12.

Figure 12:
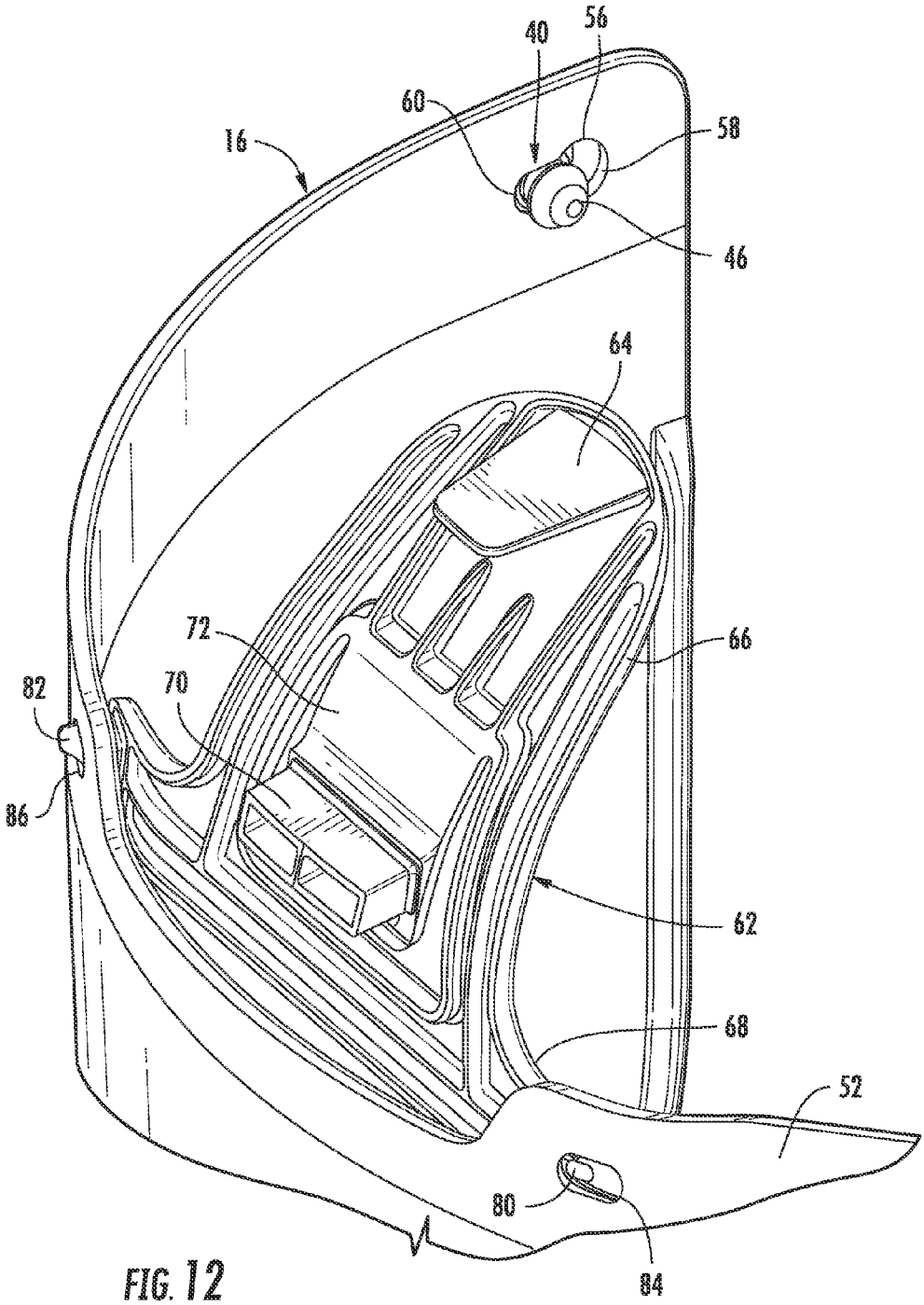
FIG. 12 is a cutaway perspective view showing engagement of the detents of the latch lever in openings in the lens.

Turning to FIGS. 5, 12 and 14, the upper peripheral edge of the lens includes a pair of spaced openings configured and arranged to receive and releasably engage the forwardly extending detents on the engagement end of the latch lever.

While the illustrated embodiment of the latching mechanism is shown to utilize a pair of spaced detents and corresponding openings, it should be understood, that the latching mechanism can be implemented with a variety of detent and opening configurations so long as the engagement end includes at least one detent that engages with a corresponding opening.

In operation, the latch lever is pivotably movable about the fulcrum between an engaged position, wherein the detents on the lower engagement end project forwardly into engagement with the openings in the upper peripheral edge of the lens and a released position wherein the detents are disengaged from the opening.

To retain the latch lever detents in engagement with the openings in the lens, a spring is captured between the upper actuator end of the latch lever and the inner surface of the crown where the spring normally biases the latch lever into engagement with the lens. Preferably, the spring is integrally molded as part of the latch lever and comprises a leaf spring having a proximal end depending from the front surface of the upper actuating end of the latch lever. The spring extends forwardly where the terminal end thereof engages with the inner surface of the crown. When the latch lever is installed, the spring becomes captured and is lightly compressed forcing the upper actuating end rearwardly and the lower engagement end forwardly (see arrows in FIG. 11).

In summary, it can be appreciated from the foregoing description and illustrations that a user may easily grasp the crown 12 with the user's thumb on the outside of the crown and the opposed fingers on the inside of the crown 12 and squeeze the actuator end 66 of the latch lever 62 toward the inside of the crown to disengage the lens 16. Since the lever 62 provides an effective moment arm, very little effort is needed to move the latch. With the other hand, the user can simultaneously grasp the bottom edge of the lens 16 and rotate the lens 16 out of the channel 36. Thereafter, the disengaged lens 16 can be easily disassembled from the rotational studs 38, 40 by simply sliding the lens 16 forwardly and sliding the lens 16 off of the studs 38, 40. A new lens is then installed in the reverse order. It can also be appreciated that all of the foregoing steps can be readily accomplished with gloved hands, thus making it convenient for the user to replace lenses in the field without much effort or distraction.

Accordingly, among the objects of the present latch mechanism are the provision of an improved latching mechanism for the lens that will reduce the time, effort and complexity involved in the replacement of a damaged or compromised lens in a protective face shield, an improved latching mechanism that can be easily manipulated while wearing gloves, a latching mechanism which is natural to use, easy to locate, and easily accessible, and a latching mechanism which is accessible from the open rearward edge of the crown.

For these reasons, the present latching mechanism is believed to represent a significant advancement in the art, which has substantial commercial merit.

While there is shown and described herein certain specific structure embodying the latch mechanism, it will be manifest to those skilled in the art that various modifications and rearrangements of the parts may be made without departing from the spirit and scope of the underlying concept and that the same is not limited to the particular forms herein shown and described except insofar as indicated by the scope of the appended claim.

What is claimed is:

1. A protective face shield comprising:

a crown having a shape contoured to conform to the shape of a forehead, said crown having a forward edge, a rearward edge and an opposing pair of rotational studs extending inwardly from an inner surface of said forward edge at opposing sides thereof;

a head gear pivotably secured to said crown;

an arcuate lens having an upper peripheral edge and opposing side edges, said upper peripheral edge including an opposing pair of keyhole-shaped slots adjacent said opposing side edges, said keyhole-shaped slots being configured and arranged to receive and rotatably engage said rotational studs whereby said lens is rotatable upwardly about said studs into interfitting engagement within said forward edge of said crown, a latch lever having an upper actuator end, a lower engagement end and a fulcrum located therebetween, said lower engagement end including at least one forwardly extending detent, said fulcrum being secured to an inner surface of said crown above said forward edge wherein said lower engagement end extends toward said forward edge of said crown and said upper actuator end extends toward said rearward edge of said crown and is accessible from said rearward edge of said crown, said upper peripheral edge of said lens further including an opening therein configured and arranged to receive and releasably engage said forwardly extending detent on said lower engagement end of said latch lever, said latch lever being pivotably movable about said fulcrum between an engaged position wherein said detent on said lower engagement end projects forwardly into engagement with said opening in said upper peripheral edge of said lens and a released position wherein said detent is disengaged from said opening; and a spring captured between said upper actuator end of said latch lever and said inner surface of said crown adjacent said rearward edge of said crown, said spring normally biasing said latch lever to said engaged position.

2. The face shield of claim 1 wherein said upper actuator end of said latch lever is formed in the shape of a paddle to facilitate movement from said engaged position to said released position.

3. The face shield of claim 2 wherein said upper actuator end of said latch lever has a width of greater than 1 inch.

4. The face shield of claim 3 wherein said upper actuator end of said latch lever has a width of about 2 inches.

5. The face shield of claim 1 wherein said at least one forwardly extending detent comprises a pair of spaced detents, and said upper peripheral edge of said lens includes a corresponding pair of spaced openings for receiving said spaced detents.

6. The face shield of claim 1 wherein said fulcrum, said upper actuator end and said lower engagement end of said latch lever are integrally formed, said fulcrum being formed as a flexible tab depending downwardly from a central portion of a lower portion of said upper actuator end, said lower engagement end having a horizontally extending body portion supported by spaced arms which depend downwardly from outer portions of the lower edge of said upper actuator end.

7. The face shield of claim 6 wherein said spring is integrally formed with and extends forwardly from a forwardly facing surface of said upper actuator end.

8. The face shield of claim 2 wherein said fulcrum, said upper actuator end and said lower engagement end of said latch lever are integrally formed, said fulcrum being formed as a flexible tab depending downwardly from a central portion of a lower portion of said upper actuator end, said lower engagement end having a horizontally extending body portion supported by spaced arms which depend downwardly from outer portions of the lower edge of said upper actuator end.

9. The face shield of claim 8 wherein said spring is integrally formed with and extends forwardly from said upper actuator end.

10. The face shield of claim 1 wherein said forward edge of said crown includes an outer depending wall and an inner depending wall spaced radially inwardly from the outer depending wall to define a channel therebetween, said upper peripheral edge of said lens being seated within said channel.

11. A protective face shield comprising:

a crown having a shape contoured to conform to the shape of a forehead, said crown having a forward edge and an rearward edge;

a head gear pivotably secured to said crown;

an arcuate lens having an upper peripheral edge and opposing side edges, said upper peripheral edge of said lens and an inner surface of said crown including rotatable, interfitting mating formations at the opposing sides thereof;

a latch lever having an upper actuator end, a lower engagement end and a fulcrum located therebetween, said lower engagement end including at least one forwardly extending detent, said fulcrum being secured to an inner surface of said crown above said forward edge wherein said lower engagement end extends downwardly toward said forward edge of said crown and said upper actuator end extends upwardly toward said rearward edge of said crown and is accessible from said rearward edge of said crown, said upper peripheral edge of said lens further including an opening configured and arranged to receive and releasably engage said forwardly extending detent on said lower engagement end of said latch lever, said latch lever being pivotably movable about said fulcrum between an engaged position wherein said detent on said lower engagement end projects forwardly into engagement with said opening in said upper peripheral edge of said lens and a released position wherein said detent is disengaged from said opening; and a spring captured between said upper actuator end of said latch lever and said inner surface of said crown, said spring normally biasing said latch lever to said engaged position.

12. The face shield of claim 11 wherein said upper actuator end of said latch lever is formed in the shape of a paddle to facilitate movement from said engaged position to said released position.

13. The face shield of claim 12 wherein said upper actuator end of said latch lever has a width of greater than 1 inch.

14. The face shield of claim 13 wherein said upper actuator end of said latch lever has a width of about 2 inches.

15. The face shield of claim 11 wherein said at least one forwardly extending detent comprises a pair of spaced detents, and said upper peripheral edge of said lens includes a corresponding pair of spaced openings for receiving said spaced detents.

16. The face shield of claim 11 wherein said fulcrum, said upper actuator end and said lower engagement end of said latch lever are integrally formed, said fulcrum being formed as a flexible tab depending downwardly from a central portion of a lower portion of said upper actuator end, said lower engagement end having a horizontally extending body portion supported by spaced arms which depend downwardly from outer portions of the lower edge of said upper actuator end.

17. The face shield of claim 16 wherein said spring is integrally formed with and extends forwardly from said upper actuator end.

18. The face shield of claim 12 wherein said fulcrum, said upper actuator end and said lower engagement end of said latch lever are integrally formed, said fulcrum being formed as a flexible tab depending downwardly from a central portion of a lower portion of said upper actuator end, said lower engagement end having a horizontally extending body portion supported by spaced arms which depend downwardly from outer portions of the lower edge of said upper actuator end.

19. The face shield of claim 18 wherein said spring is integrally formed with and extends forwardly from said upper actuator end.

* * * * *